US005151054A

United States Patent [19]

Briones et al.

[11] Patent Number: 5,151,054

[45] Date of Patent: Sep. 29, 1992

[54] ELECTRICAL CONNECTOR SHELL AND GROUNDING SPRING THEREFOR

[75] Inventors: Francisco R. Briones, Markham; Kamal S. Boutros, Downsview, both of Canada

[73] Assignee: Amphenol Corporation, Wallingford, Conn.

[21] Appl. No.: 704,117

[22] Filed: May 22, 1991

[51] Int. Cl.[5] ..... H01R 13/66

[52] U.S. Cl. ..... 439/620; 439/904; 333/185

[58] Field of Search ..... 333/181-185; 29/837, 876, 881, 884, 854, 882, 827, 832; 439/620, 607-610, 904

[56] References Cited

U.S. PATENT DOCUMENTS

| | | | |
|---|---|---|---|
| 4,371,226 | 2/1983 | Brancelone | 439/620 |
| 4,500,159 | 2/1985 | Briones et al. | 339/147 |
| 4,643,509 | 2/1987 | Hollyday et al. | 439/620 |
| 4,804,332 | 2/1989 | Pirc | 439/620 |
| 4,880,397 | 11/1989 | Dawson, Jr. et al. | 439/620 |
| 4,884,982 | 12/1989 | Fleming et al. | 439/620 |
| 4,930,200 | 6/1990 | Brush, Jr. et al. | 439/620 |
| 4,959,626 | 9/1990 | Mouissie | 459/620 |

*Primary Examiner*—David L. Pirlot
*Attorney, Agent, or Firm*—Bacon & Thomas

[57] ABSTRACT

An electrical connector includes a plastic housing having a plurality of cavities into which filter elements are inserted. The cavities communicate with a passage in which contacts are held such that the filter elements contact the electrical contacts. The filter elements are biased against the electrical contacts by a grounding spring having integral fingers extending into the cavities to provide an inwardly directed resilient biasing force when the grounding spring is secured to the connector by, for example, tabs which fit into slots in the dielectric housing. The grounding spring also includes a flange which fits over a mating flange on the housing and is sandwiched between the housing and a corresponding connector or electrical device when the connector is coupled with the corresponding connector or electrical device to thereby provide a direct and uninterrupted ground path from the filter element to the corresponding connector or electrical device. The filter elements may be chip capacitors, metal oxide varistor chips, or similar EMI protection elements.

14 Claims, 2 Drawing Sheets

ELECTRICAL CONNECTOR SHELL AND GROUNDING SPRING THEREFOR

BACKGROUND OF THE INVENTION

1. Field of the Invention

The present invention relates to an electrical connector, and in particular to a filtered electrical connector of the type using discrete, monolithic chip-type capacitors, metal oxide varistors, or diodes electrically coupled between individual contacts and a shell of the connector.

2. Description of Related Art

Electrical connector assemblies which utilize filters to protect vulnerable electronic equipment from electromagnetic interference (EMI) or transients present in communication or data bus lines are well known. Recently, filtered electrical connectors have been developed which use monolithic capacitor technology, in particular, miniature chip-type capacitor filters, to greatly simplify assembly by eliminating the relatively difficult step of soldering the miniature capacitors in order to establish electrical connections between the shell and the contacts. Elimination of solder connections minimizes potential damage both during assembly and during handling. One such connector arrangement is shown in U.S. Pat. No. 4,500,159.

The filtered electrical connector disclosed in U.S. Pat. No. 4,500,159 includes an insulator body having a plurality of cavities extending transverse to the axis of the connector contacts. Each cavity communicates with one respective contact, and each receives a single discrete monolithic chip-type capacitor for filtering the associated electrical contact. The individual capacitors comprise dielectric substrates having a live and a ground electrode, with the live electrode contacting the electrical contact and the ground electrode being electrically coupled to the shell.

Solderless connections are made possible by providing an integral leaf spring member made of an electrically conductive material and including a flange having a plurality of spring tines. The flange is mounted to the insulator body and the spring tines extend from the flange, each spring tine interconnecting with one respective capacitor to bias the capacitor inwardly against a contact and the main body of the spring outwardly against the inner wall of the connector shell.

Alternatively, the aforementioned patent also teaches solderless coupling means which include a flexible spring tine of electrically conductive material extending from each respective electrical contact, each spring tine having a first portion integrally connected to the contact and a second portion contacting the ground electrode of a capacitor, thereby biasing the capacitor outwardly into contacting relation against the connector shell.

The connector disclosed in U.S. Pat. No. 4,500,159 clearly has numerous advantages, including effective reduction of ground inductance interference, simplified assembly and repair, modular construction, and improved reliability. Nevertheless, this connector has a disadvantage in that it requires a double housing construction, including both a dielectric housing for the contacts and an outer metal shell. It would be desirable to provide an arrangement in which a direct path to ground was provided without the need for an outer metal shell, thus permitting all plastic construction of the connector housing.

BRIEF SUMMARY OF THE INVENTION

A primary objective of the invention is to provide a filtered electrical connector which utilizes solderless assembly techniques and which provides a direct path to ground without the need for a separate conductive outer metal shell, thereby adding the advantages of lighter weight, a decreased number of parts, and decreased unit cost associated with all plastic housing construction to the advantages of simplified assembly and improved filtering associated with previous solderless EMI filter connector constructions.

It is a further objective of the invention to provide a filtered electrical connector which utilizes solderless assembly techniques and which provides a direct path to ground via a monolithic filter chip such as a miniature chip capacitor or metal oxide varistor chip, without the need for a separate conductive outer metal shell.

It is a still further object of the invention to provide a method of assembling a solderless EMI filter connector which does not require the steps of providing a conductive metal outer connector shell and electrically connecting the filters to the outer shell, and which utilizes monolithic filter chips including miniature chip capacitors or metal oxide varistor chips.

These objectives are accomplished by providing a filter chip biasing spring which functions both to bias the filter chips against their respective contacts and also as a conductive outer ground contact for the connector, eliminating the need for a rigid outer metal shell.

In a preferred embodiment of the invention, the connector includes a plastic connector shell having a plurality of cavities extending transverse to the axis of the connector contacts, each cavity communicating with one respective contact. Monolithic chip-type capacitors, metal oxide varistors, or other filter or transient suppression elements are provided in the cavities, each element including a live electrode and a ground electrode, with the live electrode contacting the electrical connector contact and the ground electrode being electrically coupled to the combined biasing and outer grounding means.

The outer grounding means of the preferred embodiment include leaf spring members having a plurality of spring contact tines or fingers which enter the cavities, upon attachment of the spring members directly to the insulator body, in order to bias the filter elements against their respective contacts and establish a secure electrical connection between the grounding electrodes of the filter elements and the leaf spring members.

In an especially advantageous embodiment of the invention, the leaf spring members also include flanges which extend around lateral sides of the insulator body in a direction transverse to the contact direction in order to directly contact the device to which the connector is coupled and thereby provide an uninterrupted path from the grounding electrodes of the filter elements directly to the equipment or return ground.

DETAILED DESCRIPTION OF THE PREFERRED EMBODIMENTS

Figure 1:
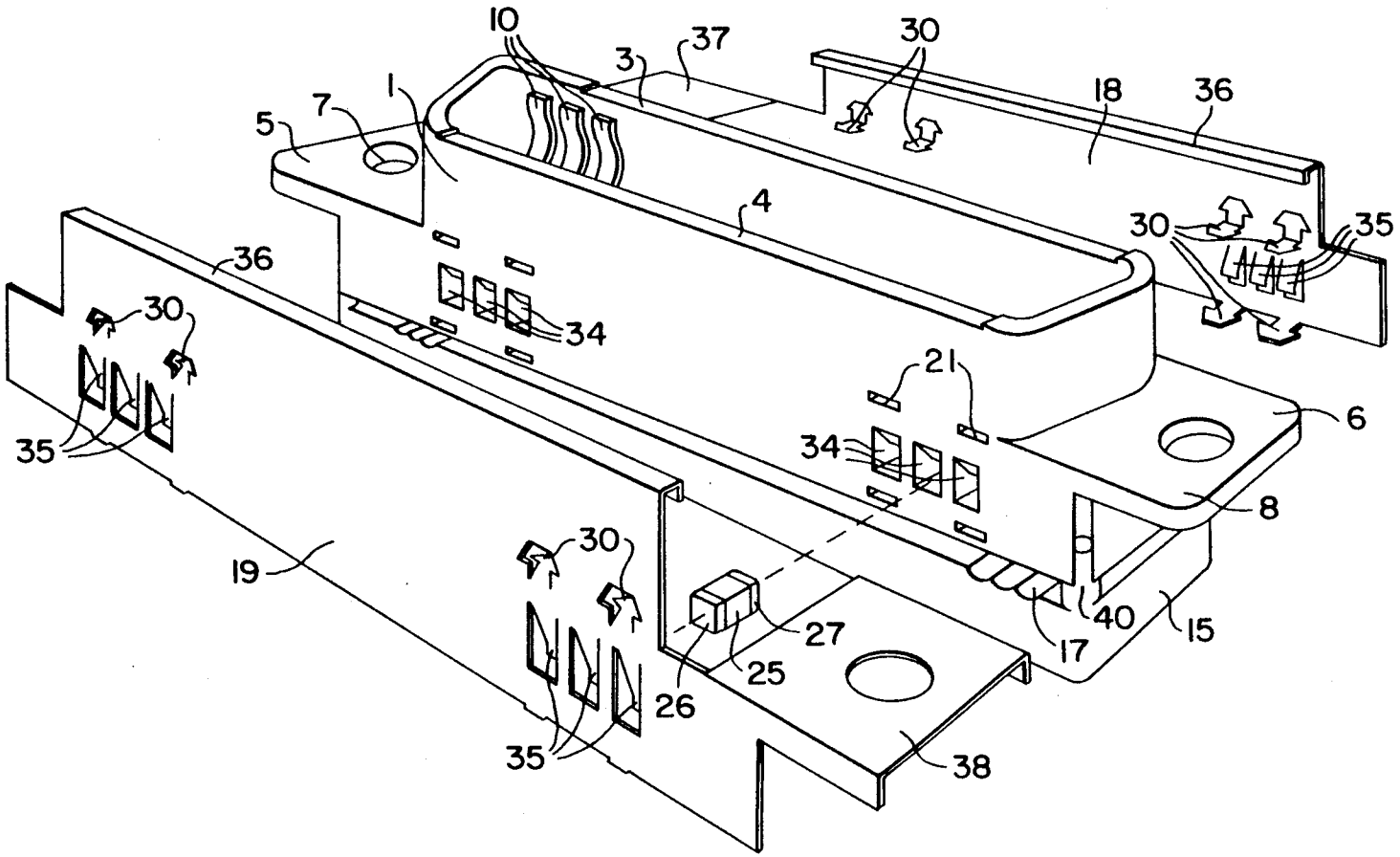
FIG. 1 is an exploded perspective view of a filtered electrical connector according to a preferred embodiment of the invention.

FIG. 1 is a perspective view of a filtered electrical connector according to a preferred embodiment of the invention, including a housing or connector shell made entirely of a non-conductive plastic material. Numerous suitable plastics are known in the art. Connector shell 1 includes a D-shaped front portion 2 which is dimensioned to fit within a corresponding D-shaped opening in a mating connector or electrical device. D-shape portion 2 includes recesses 3 and 4 provided at both the wider and narrower portions of the D for the purpose of seating curved portions 36 of grounding springs 18 and 19, as will be explained in more detail below.

Flanges 5 and 6 on the plastic connector shell are integrally molded with the main body of the shell and include openings 7 and 8 for accommodating a screw, bolt, or other fastener by which the connector is secured to the mating connector or electrical device. It will of course be appreciated that numerous securing means other than screws and bolts may also be provided to connect the connector shell with a corresponding panel or electrical device, including latches and clips of various types known to those skilled in the art. In addition, the front portion of the connector shell may be provided with cross-sectional shapes other than the exemplary D-shape, for example oval or rectangular shapes. The D-shape polarizes the connector to prevent improper insertion, but a trapezoidal shape, for example, would work just as well.

The connector shown in FIG. 1 is an insulation displacement type flat cable connector header. Leaf spring contacts 10 of known type include a resilient front portion 11 which contacts corresponding electrical contact surfaces in a mating receptacle upon mating. These contacts are inserted into a passage or passages in the plastic shell 1 and are secured in place by an insulating or dielectric rear securing member 13 which may preferably be made of the same plastic material as connector shell 1. The rear portions 12 of the contacts are provided, according to the preferred embodiment, in the form of insulation displacement contacts having end portions 14 which penetrate a flat or ribbon cable (not shown) to ensure electrical contact between the contacts and individual conductors in the cable.

A plastic backshell portion 15 having slots 16 for accommodating the insulation displacement contacts and grooves 17 for accommodating individual conductors of the cable and the insulation surrounding them is also provided, as is well known in the art. The backshell portion 15 may be secured to the plastic front shell 1 by posts 40, or by any other suitable fastening method, including clips, screws, clamps, and various adhesives.

Figure 2:
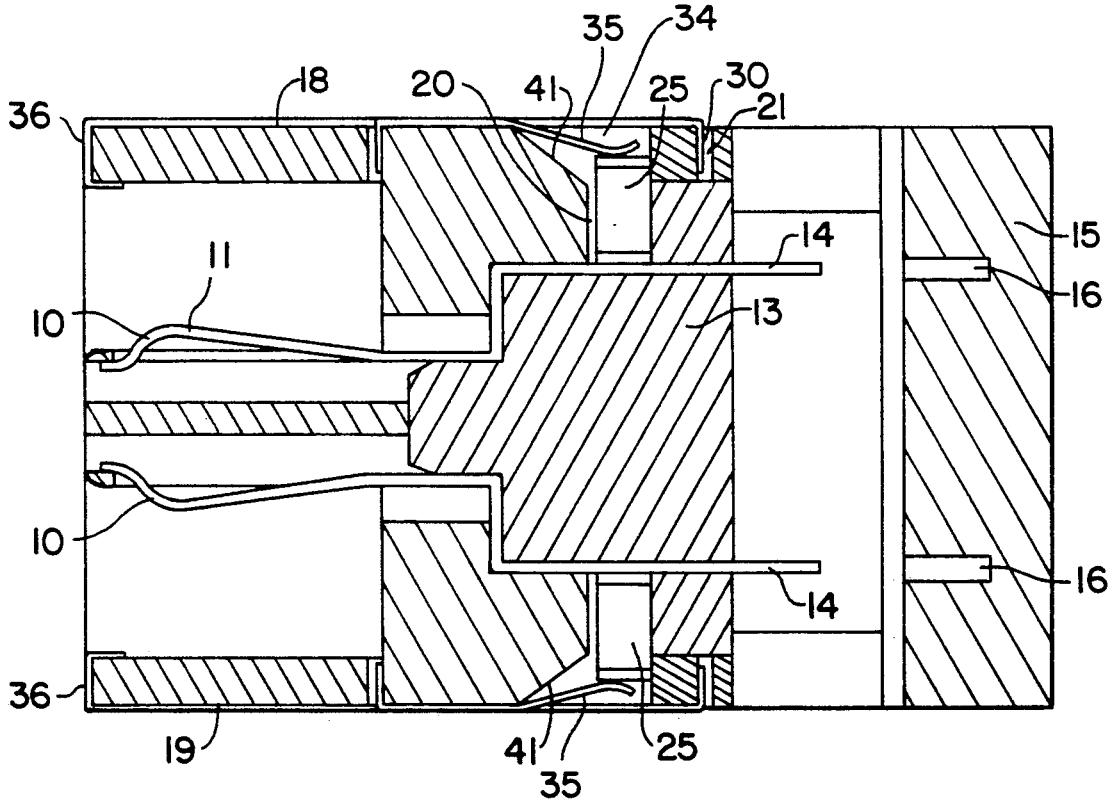
FIG. 2 is a cross-sectional side view of the filtered electrical connector shown in FIG. 1.

As is best shown in FIG. 2, plastic shell 1 includes recesses or cavities 20 in which are placed individual capacitors or other filter or transient suppression elements 25 having planar electrodes at each end. In addition to capacitors, monolithic chip-type metal oxide varistors, diodes, or combinations thereof, may also be provided in the recesses, depending on the type of filtering or transient suppression needed. It is intended that the invention be applicable to all such types of filter or transient suppression elements.

The rear portion 8 of the connector shell 1 includes a row of recesses 20 for receiving filter elements 25, each filter element having respective outer and inner electrodes 26 and 27. Inner electrodes 27 abut contacts 10 while outer electrodes 26 of the filter elements face respective openings 34 of recesses 20 and are set back a short distance so that they do not protrude out of the cavities 20. Also provided in plastic shell 1 are slots 21 and 22 for receiving securing tabs 30 on the grounding springs 18 and 19.

The outer electrodes 26 are electrically connected to ground via fingers 35 which project inward a sufficient distance so that the inward portions of the fingers engage the outer electrodes while exerting a biasing force to bias the inner electrode against the spring contacts thus eliminating the need for soldering while achieving a reliable electrical connection. In order to achieve a biasing effect, the amount by which spring fingers 35 extend into apertures 20 should be greater than the amount by which the outer electrode is inset into the aperture. To facilitate entry of fingers 35 into cavities, the openings of the cavities which face the exterior of the housing may include bevelled portions 41.

Tabs 30 includes extensions having angled surfaces to guide the tabs into slots 21. Extensions 32 may be wider than slots 21, while slots 21 are thicker than tabs 30 such that the tabs flex slightly upon entering the slots. When the tabs are fully inserted into the slots the edges 33 engage an inner surface of the shell to prevent the grounding spring from being removed from the shell. In order to completely secure the grounding spring to the all plastic shell, the grounding springs are each provided with a curved flange 36 dimensioned to fit within recesses 3 and 4, wrapping around the front of connector shell 1. Advantageously, at least two rows of tabs are provided for each grounding spring, although it will be appreciated that, because of flange 36, only one row is required.

In an especially advantageous embodiment of the invention, grounding springs 18 and 19 are respectively provided with extensions 37 and 38 which fit over respective flanges 5 and 6 such that openings 41 and 42 line up with openings 7 and 8. The extensions 37 and 38 are therefore sandwiched between the flange and the panel or electrical device to which the connector is mounted upon attachment of the connector to the panel or device.

If the corresponding mating surface of the panel or device is metal, then electrical contact occurs over the entire mating surface of the extension. Alternatively, the fastener element itself may provide the ground path to the device. In either case, grounding springs 18 and 19 serve not only to bias the filter elements 25 against their respective contacts, but also to provide a direct and uninterrupted connection to the device which serves as ground, thereby eliminating the need for an additional outer metal housing shell.

In order to assemble the filtered electrical connector of the invention as shown in FIGS. 1 and 2, housing 1 and contacts 10 are assembled in known fashion by placing the contacts in the housing and securing them in place via insulating member 13.

Filter elements 25 of a first row are then inserted into recesses 20 and grounding spring 18 or 19 is fitted over housing 1 such that flange 36 fits into respective recesses 3 or 4 and extension 36 or 37 fits over respective flange 5 or 6, causing openings 41 or 42 and 7 or 8 to line up, at which time tabs 30 are snapped into slots 21 and 22 while spring fingers 35 enter openings 34 to contact ground electrodes 26 and bias the filter elements against their respective contacts. The procedure is then repeated for the remaining row of filter elements and for corresponding grounding spring 19 or 18.

After assembly of the grounding springs to the connector, a cable may be secured to the connector by, for example, placing the cable between plastic back shell portion 15 and the rear of plastic shell 1, and pressing backshell portion 15 against housing 1 to cause insulation displacement portions at the rear of the contacts to penetrate the cable and make contact with conductors in the cable. The cable attachment portion of the assembly process is well known in the art, and may be varied depending on the type of cable for which the connector is intended. Alternatively, the connector may be adapted to be panel mounted or otherwise directly mounted on an electrical device.

It will of course be appreciated that the grounding springs and all plastic housing of the invention may be used with a variety of specific contact configurations, including a variety of known leaf spring insulation displacement contact and cylindrical contact configurations. In addition, the connector of the invention may be adapted for use with cable configurations other than flat or ribbon cables, and the monolithic filter elements may include pi filters, resistors, or spark gap elements in addition to single chip capacitors or metal oxide varistors. Numerous other variations of the invention will undoubtedly occur to those skilled in the art and, therefore it is intended that the invention not be limited to the specific embodiment disclosed above, but rather that it be defined solely by the appended claims.

We claim:

1. An electrical connector, comprising:

a dielectric housing having an exterior surface;

electrical contact means including an electrical contact provided in a passage through said housing for electrically connecting a first conductor external to said connector with a second conductor external to said connector;

cavity defining means for defining a cavity in communication with said passage and having an opening in communication with the exterior of said housing;

filter means including a filter element positioned in said cavity for electrically connecting said contact to ground;

biasing means including an electrically conductive grounding spring having an integral finger which extends into said cavity from the exterior thereof to bias said filter element in a direction of engaging said electrical contact;

housing flange means on said housing for securing said housing to a device containing said first conductor;

grounding spring flange means integrally formed as a part of said grounding spring for providing a direct uninterrupted electrical path from said filter element to ground upon being sandwiched between said housing flange means and a device to which the electrical connector is mated.

2. A connector as claimed in claim 1, further comprising grounding spring securing means integrally formed as part of said grounding spring for securing said grounding spring to said housing.

3. A connector as claimed in claim 2, wherein said grounding spring securing means comprises tabs and said housing comprises means defining slots into which said tabs may be pressed to secure said spring to said housing and thereby cause said integral finger to extend into said cavity a sufficient distance to bias said filter element against said electrical contact.

4. A connector as claimed in claim 1, wherein said grounding spring is a leaf spring.

5. A connector as claimed in claim 1, wherein said housing flange means and grounding spring flange means each includes means defining an opening through which a fastening member may be passed in order to connect said connector to a corresponding mating device including said first conductor.

6. A connector as claimed in claim 1, wherein said housing flange means comprises a flange integral with and extending from said housing in a direction transverse to the direction which said contacts extend, and said grounding spring flange means comprises a corresponding planar extension of said grounding spring.

7. A connector as claimed in claim 1, wherein said electrical contact is a leaf spring contact.

8. A connector as claimed in claim 1, wherein said filter element is a metal oxide varistor chip.

9. A connector as claimed in claim 1, wherein said cavity defining means defines a plurality of cavities in communication with said passage, said passage contains a plurality of electrical contacts, and said cavities each includes one filter element for each electrical contact, and wherein said grounding spring means is provided by a single grounding spring including a plurality of integral finger elements, one for each cavity.

10. A connector as claimed in claim 1, wherein said housing includes a D-shaped front opening through which said first conductor extends when said connector is mated to another connector.

11. A connector as claimed in claim 10, wherein said D-shaped opening includes recessed portions on opposing sides of said opening.

12. A connector as claimed in claim 11, wherein said grounding spring comprises a flange portion which fits within said recesses to further secure said grounding spring to said housing.

13. A connector as claimed in claim 1, wherein said filter element is a chip-type capacitor.

14. A connector as claimed in claim 13, wherein said chip-type capacitor includes inner and outer electrodes, said inner electrode contacting said electrical contact and said outer electrode contacting said finger.

* * * * *